US006051184A

United States Patent [19]

Kankawa

[11] Patent Number: 6,051,184

[45] Date of Patent: Apr. 18, 2000

[54] METAL POWDER INJECTION MOLDABLE COMPOSITION, AND INJECTION MOLDING AND SINTERING METHOD USING SUCH COMPOSITION

[75] Inventor: Yoshimitsu Kankawa, Otsu, Japan

[73] Assignee: Mold Research Co., Ltd., Otsu, Japan

[21] Appl. No.: 09/173,420

[22] Filed: Oct. 15, 1998

[51] Int. Cl.[7] ..... B22F 3/12

[52] U.S. Cl. ..... 419/36; 419/44; 419/54; 75/252

[58] Field of Search ..... 75/252; 419/10, 419/54, 44, 36

[56] References Cited

U.S. PATENT DOCUMENTS

| | | | |
|---|---|---|---|
| 4,197,118 | 4/1980 | Weich | 75/228 |
| 4,305,756 | 12/1981 | Weich | 75/2 |
| 4,404,166 | 9/1983 | Weich | 419/36 |
| 4,624,812 | 11/1986 | Farrow et al. | 264/63 |
| 5,043,121 | 8/1991 | Wingefeld et al. | 264/82 |
| 5,080,846 | 1/1992 | Kim et al. | 264/109 |
| 5,122,326 | 6/1992 | Jackson et al. | 264/12 |
| 5,362,791 | 11/1994 | Ebenhoech et al. | 524/440 |
| 5,531,958 | 7/1996 | Krueger | 419/44 |
| 5,695,697 | 12/1997 | Trubenbach et al. | 264/29.1 |
| 5,737,683 | 4/1998 | Sterzel | 419/36 |
| 5,746,960 | 5/1998 | Kasai et al. | 264/234 |
| 5,802,437 | 9/1998 | Wohlfromm et al. | 419/37 |
| 5,860,055 | 1/1999 | Hesse et al. | 419/36 |

OTHER PUBLICATIONS

"Ceramic Injection Molding With A Polyacetal Based Binder System", Advances In Powder Metallurgy And Panticulate Meterals, vol. 5, 1993 p 45–56.

"Modifying Polyacetal Binder Based Feedstock To Improve Quality Of MIM Parts", Advances In Powder Metallurgy And Panticulate Materials, Part 18, 1997 p 45–55.

*Primary Examiner*—Ngoclan Mai

*Attorney, Agent, or Firm*—Hodgson, Russ, Andrews, Woods & Goodyear LLP

[57] ABSTRACT

A metal powder injection moldable composition which hardly causes debinding deformation is obtained. This composition consists of a metal powder and an organic binder. The components which constitute the organic binder are:

a. polyoxymethylene having a Vicat softening temperature A≧150° C., b. polypropylene having a Vicat softening temperature B≧130° C., c. an organic compound whose viscosity at said Vicat softening temperature A (° C.) is not more than 200 mPa·s, and d. a thermoplastic resin whose Vicat softening temperature is not higher than said B (° C.).

4 Claims, 1 Drawing Sheet

METAL POWDER INJECTION MOLDABLE COMPOSITION, AND INJECTION MOLDING AND SINTERING METHOD USING SUCH COMPOSITION

TECHNICAL FIELD

The present invention relates to the technique of producing a molded body of metal powder by an injection molding method and then producing a sintered product from said molded body, and particularly it relates to the chemical makeup of an organic binder used in such injection molding method.

PRIOR ART

In recent years, to mold metal products of complicated shape, an injection molding method has been utilized. This injection molding method comprises the steps of adding various organic compounds and thermoplastic resins to a metal powder to impart fluidity thereto, heating and kneading the mixture, injection-molding the latter as a raw material for molding, and debinding and sintering the molded body, whereby a sintered product is obtained. For injection moldable compositions which have heretofore been used, especially injection moldable compositions using metal powders, in most cases use is made of polyethylene, polypropylene, methacrylate ester copolymers, and ethylene-vinyl acetate copolymer, as high molecular weight compounds, and paraffin wax, carnauba wax, etc., as low molecular weight compounds, so as to provide binders.

When these are used, however, since the percentage of debinding is low unless the thermal debinding temperature is high, there is a drawback that the residual carbon content of the sintered body is high. Further, since the thermal deformation temperature of a resin used as a binder is low, there is another drawback that the deformation which occurs during thermal debinding is high. Further, the efficiency is low since debinding and sintering are effected in separate furnaces.

DISCLOSURE OF THE INVENTION

An object of the present invention is to provide a sintered body having no defects by using an injection moldable composition which is high in thermal decomposition performance and which hardly creates thermal debinding deformation during heating in a metal powder injection molding method, thereby greatly reducing the time required for conventional thermal debinding and sintering.

According to the invention, the above object is achieved in that in a method in which a mixture of a metal powder and an organic binder is used as a raw material and injection-molded and the molded body is then debound and sintered to provide an intended product, the components of the organic binder for the metal powder are (a) polyoxymethylene, (b) polypropylene, (c) an organic compound whose viscosity at the Vicat softening temperature of said polyoxymethylene is 200 mPa·s or less, and (d) a thermoplastic resin whose Vicat softening temperature is not higher than the Vicat softening temperature of said polyoxymethylene, thereby solving said problem.

That is, in the present invention, what is composed of a polypropylene whose Vicat softening temperature is not lower than 150° C., a polypropylene whose Vicat softening temperature is not lower than 130° C., an organic binder whose viscosity at the Vicat softening temperature of said polyoxymethylene is not less than 200 mPa·s, and a thermoplastic resin whose Vicat softening temperature is not higher than that of said polypropylene was added as a binder to a metal powder, the mixture was then injection-molded, the molded body obtained thereby was put directly in a sintering furnace in which it was heated at a temperature rising rate of 5–150° C./hr between treatment temperatures of 50 and 600° C. and at pressures of 0.1–500 torr, the temperature being then elevated for further heating at a temperature rising rate of 50–400° C./hr until a maximum temperature of 1,500° C. or thereabouts was reached, whereby a metal sintered body was obtained in a short time, which had no defects, such as deformation, blisters and cracks, and whose residual carbon content from the binder was very small.

In the present invention, the polyoxymethylene used as the organic binder component (a) is an indispensable substance in that it increases the strength of the molded body, prevents deformation of the molded body which occurs at temperatures of not higher than 600° C. in sintering, and does not remain after sintering. In other words, the characteristic feature of this component whose Vicat softening temperature is not lower than 150° C. and which does not remain during thermal cracking can rarely be found in any substance except polyoxymethylene. If the amount of polyoxymethylene added is less than 5 vol %, the strength of the molded body is low, and the deformation at temperatures of not higher than 600 ° C. in sintering increases. If the amount of polyoxymethylene added exceeds 20 vol %, the injection molding temperature has to be increased, tending to produce defects in the molded body. Further, vigorous thermal cracking at temperatures of not higher than 600° C. in sintering results in cracks and blisters. If the Vicat softening temperature of the polyoxymethylene used is lower than 150° C., the molded body deforms in a temperature region of not higher than 600° C. in sintering.

The polypropylene used as the component (b) of the organic binder of the invention imparts toughness to the molded body and prevents cracking during sintering and separation of low melting point compounds added. And this resin also has a characteristic feature that it does not remain after sintering. A similar property is found in polyethylene and ethylene-vinyl acetate copolymer, but their Vicat softening temperatures are not higher than 130° C., so that they cannot be employed. If the amount of polypropylene to be added is less than 10 vol %, exudation of wax occurs to a large degree during molding, causing defects in the sintered body. Further, if the amount of polypropylene to be added exceeds 40 vol %, the deformation of the molded body at not higher than 600° C. in sintering becomes larger. If the Vicat softening temperature of the polypropylene used is lower than 130° C., the molded body deforms in a temperature region of not higher than 600° C. in sintering.

Further, if an organic compound, which is the component (c), whose viscosity at the Vicat softening temperature of the polyoxymethylene is not more than 200 mPa·s is used, it exudes out to the surface of the molded body and prevents the molded body from deforming, cracking and blistering at temperatures of not higher than 600° C. in sintering. If an organic compound whose viscosity in the temperature region of the Vicat softening temperature of the polyoxymethylene is higher than 200 mPa·s is used, exudation of wax from the molded body in a temperature region of not higher than 600° C. in sintering is rarely found, with drawbacks, such as cracks and blisters, occurring in the sintered body.

As for an organic compound (component c) in the present invention, use is made of one or more members selected from the group consisting of fatty acid esters, fatty acid amides, phthalic acid esters, paraffin wax, microcrystalline wax, polyethylene wax, polypropylene wax, carnauba wax, montan type wax, urethanated wax, maleic acid anhydride denaturation wax, and polyglycol type compounds. If the amount of addition of organic compound used is lower than 40 vol %, the fluidity during molding degrades, causing fractures or cracks in the molded body. Further, if the amount to be added exceeds 89 vol %, burrs tend to form on a body being molded, decreasing the strength of the molded body.

Finally, the addition of a thermoplastic resin, as the component (d), whose Vicat softening temperature is not higher than that of said polypropylene (b) imparts pliability to the molded body, preventing defects, such as welds and air bubbles, from appearing during molding. If the amount of addition of the thermoplastic resin (d) is lower than 5 vol %, this results in increasing the viscosity of the molded body and producing defects, such as welds and air bubbles, during molding. Further, if the amount of addition of the thermoplastic resin (d) exceeds 30 vol %, the molded body is pliable and its deformation at a temperature not higher than 600° C. in sintering is increased. As for this thermoplastic resin (d), use may be made of one or more members selected from the group consisting of polyethylene, an amorphous polyolefins, ethylene-vinyl acetate copolymer, acrylic resin, polyvinyl butyral resin, and glycidyl methacrylate resin.

If the sum of the components (a), (b), (c), and (d) of the organic binder of the present invention is less than 30 vol % by volume relative to the metal powder, the molded body tends to be brittle. Further, if the sum of the components (a), (b), (c), and (d) of the organic binder of the present invention exceeds 60 vol % by volume, the molded body tends to deform in a temperature region of not higher than 600° C. in sintering.

To prepare an injection moldable composition, an organic binder consisting of the components (a), (b), (c) and (d) is kneaded together with a metal powder using a batch type or continuous type kneading machine and the mixture is pulverized in a few millimeters, injection-molded, sintered using a sintering furnace alone without a debinding furnace, post-processed if necessary, thereby providing a product. In sintering the molded body, the pressure at a temperature between 50° C. and 600° C. is adjusted to 0.1–500 torr, whereby the organic compound (c) added exudes out to the surface of the molded body and vaporizes. If the pressure is lower than 0.1 torr, the organic compound (c) vaporizes before it exudes out to the surface of the molded body, causing fractures or blisters in the molded body. If the pressure exceeds 500 torr, the organic compound (c) hardly exudes, and the insufficient removal of the organic compound (c) from the molded body causes fractures or blisters in the molded body during thermal cracking of the polyoxymethylene (a), polypropylene (b), and thermoplastic resin (d).

As for the metal powders used in the present invention, there may be cited powders of stainless steel, iron type material, titanium, copper, nickel, etc. The average particle size of metal powders to be used in the invention is preferably 1–30 $\mu$m. If the particle size of metal powder is not larger than 1 $\mu$m, a greater amount of binder necessary for molding has to be used, tending to produce defects, such as deformation, cracks, and blisters, during debinding. Further, if the average particle size is not less than 30 $\mu$m, the powder and the binder tend to separate from each other during molding, and the density after sintering is lower, so that the strength of the sintered body obtained is also lower.

The above composition of the invention is injection-molded, the molded body obtained is put directly in a sintering furnace, where it is heated at a temperature rising rate of 5–150° C./hr between processing temperatures of 50–600° C. at a pressure of 0.1–500 torr, the temperature being then elevated at a temperature rising rate of 50–400° C./hr, so that it is sintered at 900–1,500° C., whereby a sintered body having no defects, such as deformation, blisters, and cracks, and having very little residual carbon from the binder can be obtained in a short time. In this case, if the sintering temperature is not higher than 900° C., the sintering body does not become sufficiently dense. If the maximum temperature exceeds 1,500° C., there is a danger of the molded body being melted; care should be exercised.

DETAILED DESCRIPTION OF EMBODIMENTS

Figure 1:
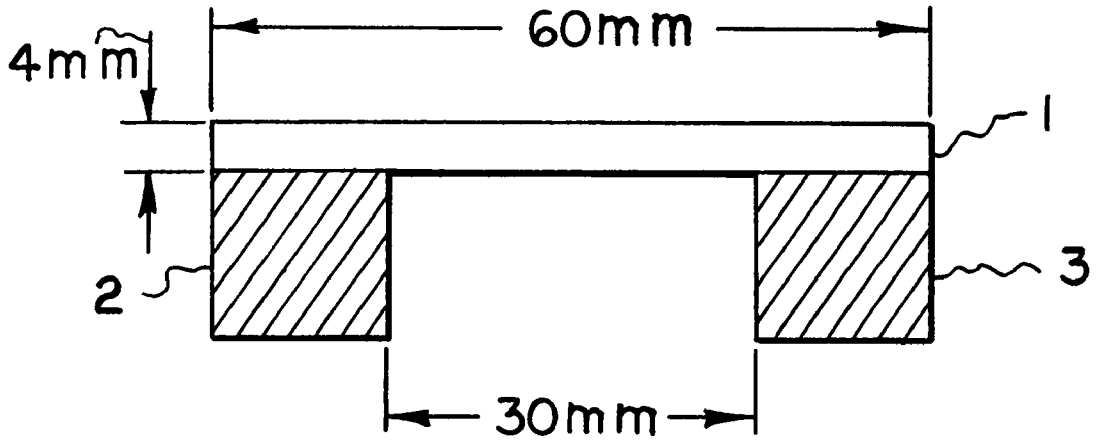
FIG. 1 is a schematic view showing how a molded body is set in a furnace.

The invention will now be described in more detail with reference to examples thereof and comparative examples, but the invention is not limited thereto.

EXAMPLE 1

First, polyoxymethylene and polypropylene were put in a pressure kneader and melted at 160° C. Thereafter, SUS316L powder (average particle size: 10 $\mu$m), paraffin wax (melting point 63° C.), polypropylene and polyvinyl butyral were put in the kneader and kneaded for 40 minutes. The kneaded body was taken out and pulverized to provide a moldable composition. Then, it was injection-molded at a molding temperature of 150° C. to provide a molded body which was 4 mm thick, 10 mm wide and 60 mm long.

| Moldable composition | |
|---|---|
| SUS316L powder | 100 parts by weight |
| Total amount of binders | 7.8 parts by weight |
| **Binder makeup** | |
| Polyoxymethylene (Vicat softening temperature 157° C.) | 10.0 vol % |
| Polypropylene (Vicat softening temperature 150° C.) | 20.0 vol % |
| Paraffin wax (viscosity is not more that 100 mPa · s at a Vicat softening temperature of 157° C.) | 40.0 vol % |
| Polypropylene wax (viscosity is not more than 100 mPa · s at a Vicat softening temperature of 157° C.) | 10.0 vol % |
| Polyvinyl butyral (Vicat softening temperature: not higher than 80° C.) | 20.0 vol % |

EXAMPLE 2

First, polyoxymethylene and polypropylene were put in a pressure kneader and melted at 160° C. Thereafter, SUS304 powder (average particle size: 12 m), paraffin wax (melting point 46° C.), carnauba wax and polybutyl methacrylate were put in the kneader and kneaded for 40 minutes. The kneaded body was taken out and pulverized to provide a moldable composition. Then, it was injection-molded at a molding temperature of 170° C. to provide a molded body which was 4 mm thick, 10 mm wide and 60 mm long.

| Moldable composition | |
|---|---|
| SUS304 powder | 100 parts by weight |
| Total amount of binders | 7.8 parts by weight |
| **Binder makeup** | |
| Polyoxymethylene (Vicat softening temperature 157° C.) | 20.0 vol % |
| Polypropylene (Vicat softening temperature 150° C.) | 20.0 vol % |
| Paraffin wax (viscosity is not more than 100 mPa · s at a Vicat softening temperature of 157° C.) | 40.0 vol % |
| Carnauba wax (viscosity is not more that 100 mPa · s at a Vicat softening temperature of 157° C.) | 10.0 vol % |
| Polybutyl methacrylate (Vicat softening temperature: not higher than 80° C.) | 10.0 vol % |

EXAMPLE 3

First, polyoxymethylene and polypropylene were put in a pressure kneader and melted at 160° C. Thereafter, 8% iron-nickel powder (average particle size: 8 μm), glycidyl methacrylate, paraffin wax (melting point 63° C.), and urethanated wax were put in the kneader and kneaded for 40 minutes. The kneaded body was taken out and pulverized to provide a moldable composition. Then, it was injection-molded at a molding temperature of 160° C. to provide a molded body which was 4 mm thick, 10 mm wide and 60 mm long.

| Moldable composition | |
|---|---|
| 2% iron-nickel powder | 100 parts by weight |
| Total amount of binders | 7.0 parts by weight |
| **Binder makeup** | |
| Polyoxymethylene (Vicat softening temperature 157° C.) | 10.0 vol % |
| Polypropylene (Vicat softening temperature 150° C.) | 20.0 vol % |
| Paraffin wax (viscosity is not more than 100 mPa · s at a Vicat softening temperature of 157° C.) | 45.0 vol % |
| Carnauba wax (viscosity is not more than 100 mPa · s at a Vicat softening temperature of 157° C.) | 15.0 vol % |
| Glycidyl methacrylate (Vicat softening temperature: not higher than 100° C.) | 10.0 vol% |

COMPARATIVE EXAMPLE 1

As in Examples 1 through 3, first, ethylene-vinyl acetate copolymer, which is a thermoplastic resin, polystyrene and polybutyl methacrylate were put in a pressure kneader, in which they weremelted at 160° C. Thereafter, SUS316L powder (average particle size: 10 μm) and paraffin wax (melting point 46° C.) were put in the kneader and kneaded for 40 minutes. The kneaded body was taken out and pulverized to provide a moldable composition. Then, it was injection-molded at a molding temperature of 140° C. to provide a molded body which was 4 mm thick, 10 mm wide and 60 mm long.

| Moldable composition | |
|---|---|
| SUS316L powder | 100 parts by weight |
| Total amount of binders | 7.8 parts by weight |

-continued

| Binder makeup | |
|---|---|
| Ethylene-vinyl acetate copolymer (Vicat softening temperature 157° C.) | 20.0 vol % |
| Polystyrene (Vicat softening temperature 120° C.) | 15.0 vol % |
| Polybutyl methacrylate (Vicat softening temperature: not higher than 80° C.) | 15 vol % |
| Paraffin wax (viscosity is not more than 100 mPa · s at a Vicat softening temperature of 157° C.) | 50.0 vol % |

COMPARATIVE EXAMPLE 2

First, ethylene-vinyl acetate copolymer, which is a thermoplastic resin, and high density polyethylene were put in a pressure kneader, in which they were melted at 160° C. Thereafter, SUS316L powder (average particle size: 10 μm) and paraffin wax (melting point 46° C.) were put in the kneader and kneaded for 40 minutes. The kneaded body was taken out and pulverized to provide a moldable composition. Then, it was injection-molded at a molding temperature of 140° C. to provide a molded body which was 4 mm thick, 10 mm wide and 60 mm long.

| Moldable composition | |
|---|---|
| SUS316L powder | 100 parts by weight |
| Total amount of binders | 7.8 parts by weight |
| **Binder makeup** | |
| Ethylene-vinyl acetate copolymer (Vicat softening temperature 57° C.) | 25.0 vol % |
| High density polyethylene | 25.0 vol % |
| Paraffin wax (viscosity is not more than 100 mPa · s at a Vicat softening temperature of 157° C.) | 50.0 vol % |

COMPARATIVE EXAMPLE 3

First, polyoxymethylene and polypropylene were put in a pressure kneader and melted at 160° C. Thereafter, SUS316L powder (average particle size: 10 μm), paraffin wax (melting point 46° C.), and polyvinylbutyral were put in the kneader and kneaded for 40 minutes. The kneaded body was taken out and pulverized to provide a moldable composition. Then, it was injection-molded at a molding temperature of 150° C. to provide a molded body which was 4 mm thick, 10 mm wide and 60 mm long.

| Moldable composition | |
|---|---|
| SUS316L powder | 100 parts by weight |
| Total amount of binders | 7.8 parts by weight |
| **Binder makeup** | |
| Polyoxymethylene (Vicat softening temperature 157° C.) | 10.0 vol % |
| Polypropylene (Vicat softening temperature 150° C.) | 20.0 vol % |
| Polypropylene wax (viscosity is not less than 1000 mPa · s at a Vicat softening temperature of 157° C.) | 50.0 vol % |
| Polyvinyl butyral (Vicat softening temperature: not higher than 80° C.) | 20.0 vol % |

The injection-molded bodies obtained in Examples 1 through 3 and Comparative Examples 1 through 3 are each set in a furnace as shown in FIG. 1 and heated, with the temperature in the furnace is elevated from 50° C. to 260° C. at a temperature rising rate of 30° C./hr, in a nitrogen atmosphere at 5 torr, then the temperature was risen from 260° C. to 400° C. at a temperature rising rate of 50° C./hr, and thenceforth gradually risen at (50–400) ° C./hr, and sintering was effected at the respective maximum temperatures they reached. In the furnace, the molded body was supported at its entire longitudinal opposite end portions on a pair of stands 2, 3 like bridge girdles and the presence or absence of defects and the amount of deformation (deflection, etc.) of the molded body after sintering were observed. The results are as shown in Table 1.

TABLE 1

| | Maximum sintering temperature | Presence of defects | Amount of deformation |
|---|---|---|---|
| Example 1 | 1,350° C. | No | 0.1 mm |
| Example 2 | 1,350° C. | No | 0.1 mm |
| Example 3 | 1,250° C. | No | 0.1 mm |
| Comparative Example 1 | 1,350° C. | Blisters and cracks | 10 mm or more |
| Comparative Example 2 | 1,350° C. | Blisters and cracks | 10 mm or more |
| Comparative Example 3 | 1,350° C. | Blisters and cracks | 10 mm or more |

Satisfactory molded bodies were not obtained in the above Comparative Examples 1–3, while those in Examples 1 through 3 had no abnormality and therefore they were each thoroughly sintered at a maximum temperature of not higher than 1,500° C. The results are shown in Table 2.

TABLE 2

| | Presence of defects in sintered body | Residual carbon content of sintered body | Relative density |
|---|---|---|---|
| Example 1 | No | 60 ppm | 97% |
| Example 2 | No | 40 ppm | 96% |
| Example 3 | No | 60 ppm | 96% |

From the results of Examples and Comparative Examples, it is understood that in the case of Comparative Examples 1 and 2, since molding defects are considered to have resulted from the absence of polyoxymethylene and polypropylene, it is understood that ① the first component (a) of the organic binder should be a polyoxymethylene whose Vicat softening temperature is not lower than 150° C. and ② the second component (b) should be a polypropylene whose Vicat softening temperature is not lower than 130° C., and in the case of Comparative Example 3, since defects are considered to have resulted from the excessively high viscosity of the polypropylene wax which is the component (c), it is understood that ③ the viscosity of the organic compound which is the third component (c) should be not more than 200 mPa·s at the Vicat softening temperature of the first component (a). Further, as a known requirement concerning this type of composition, it will also be readily understood that ④ it is necessary that the Vicat softening temperature of the thermoplastic resin which is the fourth component (d) be not higher than that of the second component (b).

Concerning the components of the organic binder, shown in Table 3 is an example in which the organic compound (c) in the composition of Example 1 using SUS316L as a metal powder consists of paraffin wax alone, with the proportions of the components being varied.

TABLE 3

By Volume (vol %) Metal Powder: SUS316L

| | | Percentage addition of binder composition | | | |
|---|---|---|---|---|---|
| Makeup | Percentage addition of all binders | a: polyoxymethylene (Vicat softening point: not less than 150° C. | b: polypropylene (Vicat softening point: not less than 130° C. | c: paraffin wax (viscosity at 157° C.: not more than 100 mPa · s | d: polyvinyl bytyral (Vicat softening point 120° C. |
| Example 4 | 40 vol % | 20 vol % | 20 vol % | 50 vol % | 10 vol % |
| Example 5 | 40 vol % | 15 vol % | 25 vol % | 50 vol % | 15 vol % |
| Example 6 | 40 vol % | 10 vol % | 20 vol % | 55 vol % | 15 vol % |
| Comparative Example 4 | 72 vol % | 20 vol % | 20 vol % | 50 vol % | 10 vol % |
| Comparative Example 5 | 60 vol % | 3 vol % | 37 vol % | 50 vol % | 10 vol % |
| Comparative Example 6 | 60 vol % | 20 vol % | 5 vol % | 60 vol % | 15 vol % |
| Comparative Example 7 | 25 vol % | 20 vol % | 20 vol % | 50 vol % | 10 vol % |

In the above proportions, for Examples 4 through 6, no defects, such as cracks and blisters, were observed in the molded body, debound body, and sintered body.

In Comparative Example 4, deformation and blistering occurred during debinding. This means that since the percentage addition of the binder is excessively as high as 72 vol %, the whole of the composition exhibits its characteristics as a substantial organic binder phase, with the plastic deformation appearing throughout.

In Comparative Example 5, deformation occurred during debinding. In this case, the cause is believed to be that while the percentage addition of the binder is relatively as high as 60 vol %, the polyoxymethylene which contributes to increasing the strength of the molded body higher than does the total amount of binders is abnormally as small in amount as 3 vol %.

In Comparative Example 6, air bubbles and cracks were produced during injection molding. The cause of this is believed to stem from the fact that since the polypropylene which imparts toughness to the molded body is as small in amount as 5 vol %, the wax exudes during molding.

In Comparative Example 7, the metal powder failed to disperse in the organic compound added thereto. This is because the percentage addition of organic binder is extremely as small as 25 vol %.

After all, these results show that the percentage of the organic binder added to the metal powder and the proportions of the components of the organic binder, mentioned above, are within the proper ranges.

As has been described so far, the metal powder injection moldable composition of the invention, unlike the conventional one, makes it possible to obtain a debound body in good condition in a short time which produces almost no deformation, and no cracks, blisters, etc., after debinding. As a result, a sintered body which is superior in dimensional accuracy can be obtained in a short time.

What is claimed is:

1. A metal powder injection moldable composition comprising a metal powder and an organic binder, wherein the components which constitute said organic binder are:

a. polyoxymethylene having a Vicat softening temperature A≧150° C.;

b. polypropylene having a Vicat softening temperature B≧130° C.;

c. an organic compound whose viscoisty at said Vicat softening temperature A (° C.) is not more than 200 mPa·s; and d. a thermoplastic resin whose Vicat softening temperature is not higher than said B (° C.), and wherein said organic binder comprising said components (a), (b), (c) and (d) is added in an amount of 30–60% by volume to the metal powder, the proportions of components of said organic binder being a: 5–20 vol %, b: 10–40 vol %, c: 40–80 vol %, d: 5–30 vol %.

2. An injection moldable composition as described in claim 1, wherein the organic compound which is said component (c) is one or more members selected from the group consisting of fatty acid esters, fatty acid amides, phthalic acid esters, paraffin wax, polyethylene wax, polypropylene wax, carnauba wax, montan type wax, urethanated wax, maleic acid anhydride denaturation wax, and polyglycol type compounds.

3. An organic binder as described in claim 1, wherein the thermoplastic resin which is said component (d) is one or more members selected from the group consisting of polyethylene, amorphous polyolefins, ethylene-vinyl acetate copolymer, acrylic resin, polyvinyl butyral resin, and glycidyl methacrylate resin.

4. A method of injection-molding and sintering metal powder, comprising the steps of injection-molding an injection moldable composition which consists of a metal powder and an organic binder which consists of a. polyoxymethylene having a Vicat softening temperature A≧150° C., b. polypropylene having a Vicat softening temperature B≧130° C., c. an organic compound whose viscosity at said Vicat softening temperature A (° C.) is not more than 200 mPa·s, and d. a thermoplastic resin whose Vicat softening temperature is not higher than said B (° C.), putting the resulting molded body in a sintering furnace, heating the molded body at a temperature rising rate of 5–150° C./hr between treatment temperatures of 50 and 600° C. and at pressures of 0.1–500 torr, the temperature being then risen for further heating at a temperature rising rate of 50–400° C./hr, until a metal sintered body is obtained at a sintering temperature of 900–1,500° C.

* * * * *